US007486774B2

(12) United States Patent
Cain

(10) Patent No.: US 7,486,774 B2
(45) Date of Patent: Feb. 3, 2009

(54) REMOVABLE APERTURE COOLING STRUCTURE FOR AN X-RAY TUBE

(75) Inventor: Bruce A. Cain, South Jordan, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 11/137,064

(22) Filed: May 25, 2005

(65) Prior Publication Data

US 2006/0269048 A1 Nov. 30, 2006

(51) Int. Cl.
*H01J 35/06* (2006.01)

(52) U.S. Cl. ..... 378/136; 378/119

(58) Field of Classification Search ..... 378/130, 378/136, 139, 141, 142, 119, 144, 123, 125, 378/134

See application file for complete search history.

(56) References Cited

U.S. PATENT DOCUMENTS

| | | | | |
|---|---|---|---|---|
| 5,689,542 | A | 11/1997 | Lavering et al. | |
| 6,115,454 | A | 9/2000 | Andrews et al. | |
| 6,301,332 | B1 * | 10/2001 | Rogers et al. | 378/142 |
| 6,400,799 | B1 * | 6/2002 | Andrews | 378/141 |
| 6,519,318 | B1 * | 2/2003 | Andrews | 378/141 |
| 7,058,160 | B2 * | 6/2006 | Boye | 378/125 |
| 2002/0161483 | A1 * | 10/2002 | Vaidyanathan | 700/275 |

* cited by examiner

*Primary Examiner*—Hoon Song
(74) *Attorney, Agent, or Firm*—Workman Nydegger

(57) ABSTRACT

An x-ray tube having a removable aperture structure that can be detached from a portion of the x-ray tube without damaging either component is disclosed. The aperture structure includes heat conducting surfaces in communication with a coolant supplied to the fluid reservoir. The removable aperture structure includes a bond surface configured to receive a removable bond with the x-ray tube evacuated enclosure.

19 Claims, 5 Drawing Sheets

REMOVABLE APERTURE COOLING STRUCTURE FOR AN X-RAY TUBE

BACKGROUND

1. The Technology Field

The present invention relates generally to x-ray tubes. More particularly, embodiments of the present invention relate to removable and replaceable aperture cooling structures and methods of use.

2. The Related Technology

Recent advances in x-ray technology have resulted in x-ray tubes capable of producing increasingly detailed imaging and analysis results. Accordingly, x-ray generating devices have become valuable tools that are used in a wide variety of applications ranging from medicine to industrial and biotechnological testing. For example, x-rays are commonly used in diagnostic and therapeutic radiology, semiconductor manufacture and fabrication, and materials analysis and testing. As such, further improvements in x-ray generating devices are continually being sought.

In typical x-ray generating devices, x-rays result when high velocity electrons are slowed or stopped by atomic forces in a target substrate. In order to generate high velocity electrons, a basic x-ray tube includes an evacuated enclosure having a filament-containing cathode and a target anode. When energized during tube operation, the filament produces a cloud of electrons by thermionic emission. The application of a voltage potential between the cathode and the anode causes the electrons to become energized and accelerate toward a target surface defined on the anode, which is axially spaced apart from the cathode and oriented so as to receive the stream of high velocity electrons.

The anode target surface is typically comprised of a material having a high atomic number such as tungsten or other heavy metals. Impingement of the stream of electrons on the target surface results in the conversion of a portion of the kinetic energy of the electrons into-photons having very high frequencies, i.e., x-rays.

Once produced, the x-rays emanate from the anode target surface and are directed through a collimating window in an outer housing containing the x-ray generating device. The collimating window allows for the x-rays to be directed toward a desired object, such as a patient's body. As is well known, the variation in the ability of x-rays to penetrate regions of different densities in the object enable various details of the object to be detected and analyzed. As such, x-rays can be used in any one of a number of applications such as, for example, x-ray medical diagnostic examination or material analysis procedures.

While a large number of electrons produced by the filament result in the creation of x-rays, some of the electrons do not produce x-rays. A percentage of these electrons strike the anode target surface and simply rebound from the surface as "backscatter" electrons. Additionally, some of the high velocity electrons emitted from the filament may stray from their intended path toward the surface. If left unchecked, some of the backscatter and stray electrons can impact undesired portions of the target surface and other interior tube components, not only creating "off-focus" x-rays that compromise the quality of the x-ray image, but producing undesired excess tube heating as well.

In order to inhibit negative consequences associated with high energy backscatter and stray electrons, some x-ray tubes include a shield structure to collect these electrons. The shield structure may be positioned between the cathode and the anode so as to enable the stream of electrons to impinge the anode target surface while preventing backscatter and stray electrons from striking the target surface and producing "off-focus" x-rays, as discussed above.

As a consequence of the high kinetic energy of backscatter and stray electrons that impact the shield structure during the tube operation, significant quantities of thermal energy are produced in the shield. Moreover, the configuration of the shield structure may result in uneven heat production and distribution. This uneven heat distribution may be exaggerated due to the manner in which the shield structure is coupled to other portions of the x-ray tube. Accordingly, shield structure regions having large temperature differentials are characterized by varying rates of thermal expansion, which result in mechanical stresses that may damage the shield or proximate regions of the x-ray device, especially over numerous operating cycles.

Because such high temperature differentials may cause destructive thermal stresses and strains in the shield structure and in other parts of the x-ray device, attempts have been made to minimize these effects through the use of various types of cooling systems. One attempt has involved x-ray tubes that utilize a liquid cooling arrangement to dissipate unwanted heat. In such an arrangement, portions of the shield structure and other tube structure are placed in direct contact with a circulating coolant, which removes heat by a convective cooling process. To maximize this convective cooling, the shield structure can be fashioned with internal cooling passages through which the coolant is circulated. This allows the shield structure to give up heat primarily by convection to the coolant flowing through its interior.

Typically, the shield structure is manufactured integrally with other components of the cathode structure. For instance, the shield structure in some x-ray tubes has been integrally manufactured with a cathode cylinder or cathode can. In other instances the shield structure is separately manufactured but then permanently affixed to the cathode can or cylinder. As a result, replacement of a shield structure integrally formed with or permanently affixed to other cathode components is difficult. Replacement can irreparably damage the shield structure, cathode structure, or both. This results in material waste and added expense during tube repair or refurbishment. Further, the fabrication costs for new cathode components and shield structures employed in tubes having a liquid cooling arrangement are typically high due to the machining required to provide the internal cooling passages in these components.

In light of the above, there is a need in the art for an x-ray tube that does not suffer from the challenges outlined above regarding cathode components. Indeed, it would be advantageous for an x-ray tube to include a cathode having a shield structure that is non-destructively separable from other cathode components should replacement of the shield structure or other cathode component be necessary, thereby decreasing the overall costs of fabricating, repairing, or refurbishing the x-ray tube.

BRIEF SUMMARY OF EMBODIMENTS OF THE INVENTION

Generally, one embodiment of the present invention includes an x-ray tube having a removable aperture structure. Although an x-ray tube can have any one of a number of different configurations, in an example embodiment, the x-ray tube includes an evacuated enclosure including a cathode can housing portion, an anode housing portion and the removable aperture structure. The cathode can portion includes an electron source disposed therein, which is configured to emit electrons towards an anode target, which is disposed in the anode housing portion of the evacuated enclosure The anode has a target surface capable of receiving the electrons emitted by the electron source, where the anode is oppositely disposed with respect to the electron source. Accordingly, electrons emitted from the electron source travel across a substantially straight trajectory before colliding with the anode in order to generate x-rays.

In disclosed embodiments, the removable aperture structure defines an aperture for enabling electrons emitted by an electron source to pass to the target. In disclosed embodiments, the aperture structure is bonded to the evacuated enclosure so as to be removable. Also, the removable aperture structure can be configured with a variety of shapes so as to intercept stray and backscatter electrons so that they do not interfere with x-ray production. The removable aperture also can include one or more fluid passageways configured for circulating a coolant so that the heat generated by the stray or backscatter electrons is dissipated from the removable aperture structure. Preferably, the fluid passageway(s) would be placed in the region of the shield area, or in any region experiencing high heat.

In one embodiment, the removable aperture structure is configured with at least one surface has at least one removable bonding portion configured for receiving and maintaining a removable bond with the evacuated enclosure, such as in the region of the cathode can. Further, this bonding surface is configured for contacting the cathode can (or any other appropriate region of the x-ray tube evacuated housing) so as to orient the removable aperture structure within the x-ray tube. The removable bond enables bonding of the removable aperture structure to the evacuated housing, but also removal of the bond therebetween without significantly damaging the x-ray evacuated housing and/or the removable aperture structure. Thus, the removable aperture structure is capable of being detached without inhibiting the functionality of the x-ray tube and/or the removable aperture structure.

In another embodiment, a fluid reservoir for retaining a coolant is formed in the removable aperture structure. Preferably the fluid passageway(s) are in fluid communication with the fluid reservoir to enable circulation of the coolant. The fluid reservoir and one or more fluid passageways of the removable aperture structure form part of a cooling system for circulating coolant through the aperture structure in order to remove heat therefrom.

These and other advantages and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF EMBODIMENTS OF THE INVENTION

Before a more detailed description is given, it is to be understood that in the discussion to follow, embodiments of the present invention are not limited to the particular components, materials, combinations, and methods disclosed herein. Accordingly, this disclosure is extended to equivalents of the components, materials, combinations, and methods as would be recognized by one of ordinary skilled in the art. It should also be understood that terminology and figures discussed herein are used for the purpose of describing certain exemplary embodiments only and are not intended to be limiting of the present invention in any way.

Embodiments of the removable aperture structure and associated components disclosed herein may be usefully employed in connection with various types of x-ray devices, including rotating anode and stationary anode type x-ray devices. Moreover, the removable aperture structure may be prefabricated prior to being coupled with the x-ray tube via a removable bond, which allows the removable aperture structure to be separated from the x-ray tube without any substantial damage thereto. As such, x-ray tube can be reused with minor reconditioning.

Figure 1:
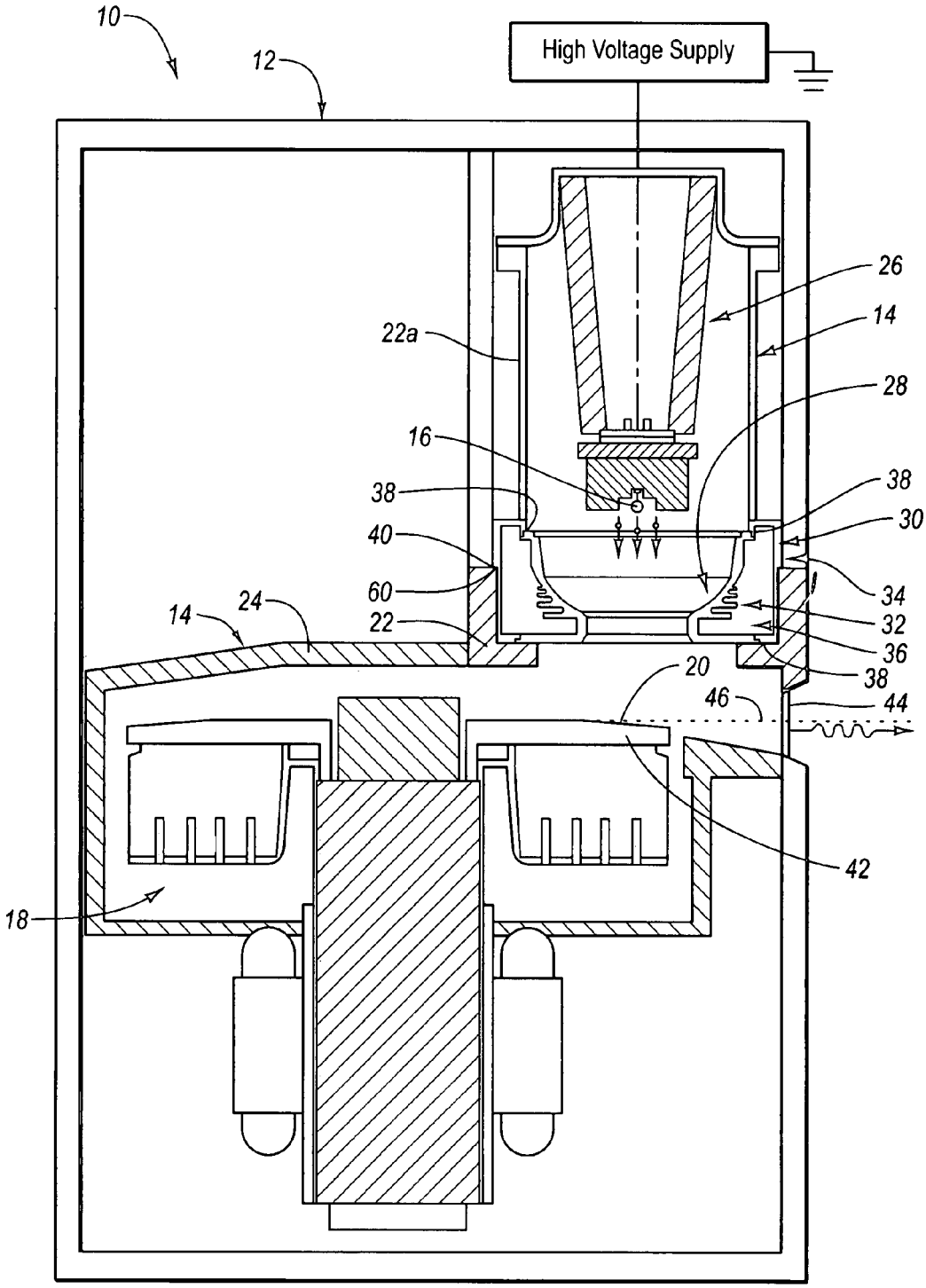
FIG. 1 is a cross-sectional view of an x-ray generating apparatus incorporating an embodiment of the present invention.

FIG. 1 depicts one embodiment of an x-ray device 10 that includes various features of the present invention. Generally, the x-ray device 10, exemplarily implemented as a rotating anode x-ray device, includes an apparatus enclosure or outer housing 12 and an evacuated envelope 14 disposed within the housing 12. Disposed within the evacuated envelope 14 is a cathode 26 and anode 42 arranged in a spaced apart configuration with respect to one another. Although any one of a number of different configurations could be used, in the illustrated embodiment the evacuated envelope 14 is partially defined by a cathode housing portion, denoted at 22 and referred to as the cathode "can, "an upper cathode housing portion, denoted at 22*a*, and an anode housing portion, denoted at 24. The cathode 26 and anode 42 each include an associated electrical connection (not shown) that collectively facilitate establishment of a high potential difference between the cathode 26 and anode 42. As discussed below, this potential difference enables the generation of x-rays.

As shown in the example embodiment, the cathode can 22 contains the cathode 26, which includes an electron source 16 and associated electronics (not shown). The electron source 16, which in one embodiment includes a filament, is configured to generate electrons by thermionic emission for use in x-ray production, as described below.

The anode housing 24 contains the rotatable anode assembly 18, which is disposed opposite the electron source 16. The rotatable anode assembly 18 includes an anode 42 having a target surface 20, exemplarily comprising tungsten or other material(s) having suitable characteristics, that is positioned to receive the stream of electrons generated by the cathode 26. In operation, an electric potential between the cathode 26 and the anode 42 causes the electrons generated by the cathode 26 to accelerate rapidly toward the target surface 20 of the anode 42. X-rays are generated as the electrons approach and strike the target surface 20, which x-rays are then collected and collimated via a collimating window 44 positioned in housing 12. The collimating window 44 enables emission of the x-rays from the x-ray tube 10 along a general x-ray path 46 toward an x-ray subject to be analyzed.

Additionally, FIG. 1 further depicts various details regarding a removable aperture structure (removable aperture"), generally designated at 30, according to one embodiment. The removable aperture 30 is preferably configured to enable electrons emitted from the electron source 16 to pass from the cathode 26 to the target surface 20, while also collecting backscatter and stray electrons during tube operation in order to prevent related problems with such electrons, including the undesired production of off-focus x-rays and excessive tube heating. Moreover, in disclosed embodiments, the removable aperture includes coolant system features that facilitate the removal of heat from regions of the removable aperture. In general, the removable aperture 30 is configured in a manner so that it can be removed from the evacuated envelope portion 14 without damaging the envelope 14, the removable aperture 30, the cathode can 22, or any other aspect of the x-ray tube 10. It will be appreciated that the specific structure and geometry of the removable aperture can vary and still provide these general features. In fact, the specific geometry used may be dictated by the particular geometry of the particular x-ray tube, evacuated enclosure, etc. that are being used. That said, in the example embodiment illustrated herein, the removable aperture 30 includes an aperture shield 32 portion and an aperture cup 34 portion that cooperate to define a fluid reservoir 36. Details regarding each of these components are given below.

Figure 2:
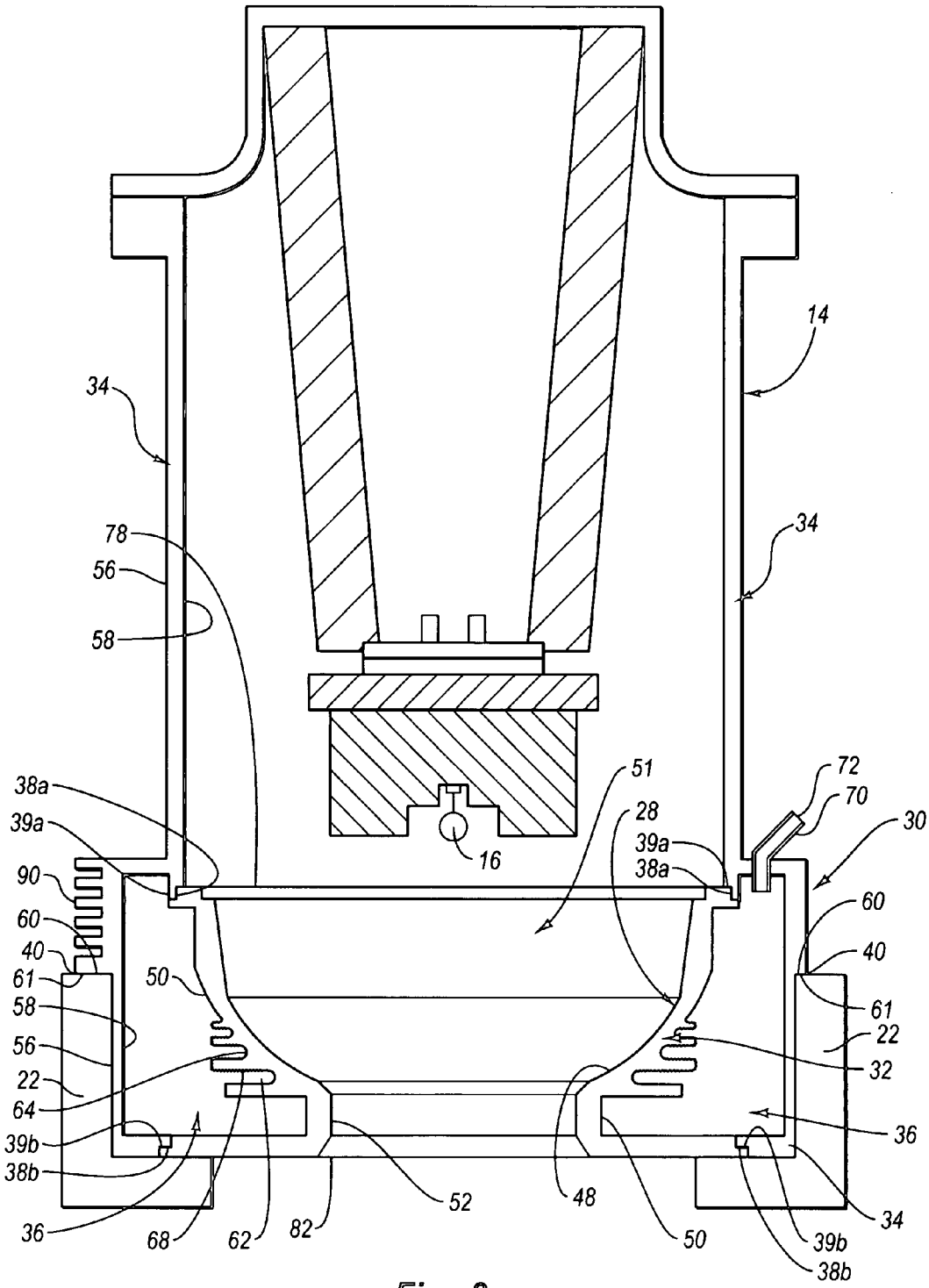
FIG. 2 is an isometric cross-sectional view of a portion of an x-ray tube having a removable aperture structure, according to one embodiment.

In the example shown, the aperture shield 32 is configured to attach with the aperture cup 34 at various integration sites, such as those denoted 38*a* and 38*b* in FIG. 2. As such, in one embodiment the aperture shield 32 and aperture cup 34 are fabricated independently prior to being attached to one another. The integration sites 38*a* and 38*b* are positioned such that, when joined, the aperture shield 32 and aperture cup 34 are an integrated piece forming part of the removable aperture 30. In one embodiment, joining of the aperture shield 32 and aperture cup 34 is accomplished before placement of the removable aperture 30 in the cathode can 22, as shown in FIG. 1.

In accordance with embodiments of the present invention, various components are described herein as preferably being permanently attached. Various means can be used to achieve such attachment including brazing, permanent welding, etc. The interfaces at which the components are permanently attached to one another are referred to herein as integration sites 38. It should be recognized that an integration site 38 can include one or more discrete locations, or can include a continuous surface defining at least a portion of the interface at which the permanent attachment occurs.

In accordance with one embodiment, the aperture cup 34 portion of the removable aperture 30 is removably bonded to the evacuated envelope 14 in the region of cathode can 22 via a removable bond 40. Accordingly, the aperture cup 34 includes an annular bonding portion 60 defining a surface that is configured to physically engage an upper portion of the cathode can 22 and to receive the removable bond 40. The bonding portion 60 is disposed on an outer periphery of the generally cylindrical aperture cup 34 such that after receipt of a portion of the aperture cup within a volume defined by the cathode can 22, the removable bond 40 can be formed between the aperture cup and the cathode can. The removable bond 40 is configured to be removably formed at the bonding portion 60 as to facilitate removal of the removable aperture 30 from the cathode can 22 at some point after bonding, such as during repair or reconditioning of the x-ray tube. This enables the removal of the bond 40 without significantly damaging the cathode can and/or the removable aperture, and also does not inhibit the functionality of the cathode can and/or the removable aperture. Removal of the aperture 30 may be needed, for instance, when failure of one or more components of the removable aperture 30 or cathode 26 occurs.

As used herein, a "removable" bond 40 is understood to include bonds that are employed to bond two components together such that the bond 40 can be removed to separate the components without destroying or significantly damaging either component. As such, each component will be capable of being reused after the removable bond 40 is functionally detached and the components are separated, assuming no other problem exists with the components. Additionally, due to vacuum envelope and fluid reservoir fluid tightness requirements in the x-ray tube, the removable bond 40 is understood to hermetically seal the two components together to preserve any hermetic barrier existing proximate to one or both components. Removable bonds can be established by a variety of means, including a removable weld, bolted flange, or other suitable configuration in accordance with the above requirements.

In practice, removable bond 40, such as a weld, may be cut to facilitate removal of the removable aperture 30 from the cathode can 22. Advantageously, after separation, one or both components can be repaired, reconditioned, cleaned, etc., if needed, before reattachment via a new removable bond 40 established between the components. More details regarding the removable aperture 30, its constituent components, and its attachment configuration within the x-ray tube are given further below.

As mentioned, during operation of the x-ray tube 10 some of the electrons that strike the target surface 20 of the anode 42 do not stimulate emission of x-rays. Instead, these electrons may rebound and backscatter from the anode. Additionally, some of the electrons emitted from the cathode stray from their intended path so that their trajectory is not aligned with the anode target surface 20. In order to prevent the problems associated with backscatter and stray electrons, the aperture shield 32 portion of the removable aperture 30 defines an electron collection surface 28, that is positioned with respect to the electron source 16 to intercept and collect such electrons. Accordingly, the collection surface 28 performs a number of valuable functions, including preventing backscatter electrons from descending and re-striking undesired portions of the anode 42, thereby preventing the generation of off-focus x-rays. In addition, the electron collection surface 28 prevents electron impacts with other components in the x-ray tube, thereby preventing the undesirable generation of heat within the x-ray tube.

While these backscatter and stray electrons are prevented from re-striking the anode or unfavorably striking other x-ray tube components, they nonetheless generate relatively large amounts of heat upon impact with the electron collection surface 28. Consequently, it is desirable that this heat be continuously removed from the electron collection surface 28 and the aperture shield 32 to prevent heat induced damage to the aperture shield 32 and other components.

In order to counteract the negative implications associated with the unfavorable heat generation discussed above, the removable aperture 30 preferably is configured with a cooling system to remove heat. In the illustrated embodiment, this is accomplished by way of a fluid reservoir and one or more fluid passageways. While any one of a number of different configurations could be used, in an example embodiment the aperture shield 32 and aperture cup 34 cooperate to define the fluid reservoir 36 as a component of the removable aperture 30. The fluid reservoir 36 is in fluid communication with an external cooling system (not shown) that enables a coolant to be supplied to the removable aperture 30 in order to facilitate its cooling during tube operation.

In detail, the external coolant system is employed to supply coolant to the fluid reservoir 36 of the removable aperture 30 in order to dissipate heat generated at the electron collection surface 28, the aperture shield 32, and in other regions of the x-ray tube 10. The coolant, which in one embodiment is a liquid coolant, is continuously circulated by the external cooling system to and from the fluid reservoir 36 during the operation via a coolant path including tubing, fixtures, and passages. As coolant is circulated into the fluid reservoir 36 during tube operation, the heat absorbed by electron collection surface 28 and other portions of the aperture shield 32 by virtue of interaction with stray and backscatter electrons is transferred to the coolant via convective and conductive heat transfer. The heated coolant is then transferred out of the fluid reservoir 36 via circulation. This continuous coolant circulation, together with convective currents in the coolant, enables the coolant to maintain a nearly uniform temperature distribution or gradient. Circulation of the coolant also enables the heated coolant to be passed to a heat exchanger (not shown) for cooling before being re-circulated back to the fluid reservoir 36.

The rate of heat transfer between tube components and the coolant is in part a function of the amount of surface area across which the heat is transferred. Accordingly, the efficiency at which heat is conducted away from the electron collection surface 28 and other portions of the aperture shield 32 to the coolant is based partly upon the surface area of these components that is in fluid communication with the coolant. As such, in one embodiment the removable aperture 30 is configured to maximize surface area in fluid communication with the coolant, as will be seen.

With reference now to FIG. 2, in one embodiment of the present invention the x-ray tube 10 (FIG. 1) includes the removable aperture 30 having the aperture shield 32 and aperture cup 34. The aperture shield 32 includes a continuous, annular interior surface 48 and a continuous, annular exterior surface 50. As such, the interior surface defines a cavity 51 extending from an upper portion 78 to a lower portion 82 of the aperture shield 32. The interior surface 48 adjacent the lower portion 82 defines an aperture 52. The placement of the aperture 52 relative to the electron source 16 and the anode (as shown in FIG. 1) allows for the passage of electrons therebetween during tube operation.

The interior surface 48 of the aperture shield 32 defines the electron collection surface 28, which was discussed above. As shown, the electron collection surface 28 is adjacent the aperture 52 so that stray or backscatter electrons preferentially impact the electron collection surface 28 rather than re-striking the anode or other x-ray tube components. Accordingly, the electron collection surface 28 is generally shaped as a concave/frustoconical surface to facilitate the capture of stray or backscatter electrons, though other configurations are possible for providing a similar "collection" function. In one embodiment, the electron collection surface 28 extends from the upper portion 78 to the lower portion 82 of the aperture shield 32. In other embodiments, the electron collection surface 28 can extend from the aperture 52 even further to a cathode cylinder.

The electron collection surface 28 is preferably comprised of a thermally conductive material so that the heat generated by the impact of electrons is withdrawn from the surface and dissipated. For example, the electron collection surface 28 can be composed of a copper, copper alloy, aluminum oxide dispersion thereof, or the like. In addition, the electron collection surface 28 is, as has been explained, integrated with the aperture shield 32. This integration increases the thermal uniformity of the removable aperture 30, thereby contributing to thermal uniformity within this region of the x-ray tube 10 (FIG. 1), and reducing temperature-related stress and strain on the removable aperture 30, as well as on adjacent x-ray tube components.

In addition to a thermally conductive electron collection surface 28, in one embodiment the entire aperture shield 32 is comprised of a thermally conductive material. Exemplary compositions for the aperture shield 32 include copper, copper alloys, or other suitable material for conducting heat from the electron collection surface 28 and other regions of the aperture shield 32. Additionally, the aperture shield 32 is in thermal communication with other thermally conductive components, such as the aperture cup 34 and cathode can 22, to further conduct heat from the aperture shield 32.

Together with a portion of the aperture cup 34, the exterior surface 50 of the aperture shield 32 defines the fluid reservoir 36, as discussed above. As such, the fluid reservoir 36 is configured to contain a coolant that is in fluid and thermal communication with the exterior surface 50. This facilitates heat removal by the coolant from the electron collection surface 28 and other portions of the aperture shield 32 in order to cool these components during tube operation.

In one embodiment, a plurality of annular fluid passageways 62 are arranged adjacent the exterior surface 50 of the aperture shield 32 as to be in fluid communication with coolant located in the fluid reservoir 36. In the illustrated embodiment, the plurality of fluid passageways 62 are defined by a plurality of annular cooling fins 68 that extend from the exterior surface 50 of the aperture shield 32 into the fluid reservoir 36 in a spaced-apart arrangement. This spaced-apart arrangement further defines recesses 64 adjacent each cooling fin 68, which recesses 64 define the fluid passageways 62, as described above. The combination of fluid passageways 62 and cooling fins 68 increases the surface area of the aperture shield 32 in contact with the coolant, thereby providing a larger surface area for facilitating heat transfer to circulating coolant. In particular, as coolant circulates via the fluid passageways 62 and the fluid reservoir 36, heat generated from the impact of electrons on the electron collection surface 28 and other aperture shield 32 surfaces is conducted from the interior surface 48 to the cooling fins 68 of the exterior surface 50, at which point the heat is convectively transferred to the coolant passing through the fluid passageways 62. In this way, the electron collection surface 28 and aperture shield 32 can be cooled during tube operation.

As discussed earlier, the upper portion 78 and lower portion 82 of the aperture shield 32 include an annular upper integration site 38*a* and an annular lower integration site 38*b*, respectively. The integration sites 38*a-b* of the aperture shield 32 cooperate with corresponding annular integration sites 39*a-b* on the aperture cup 34 to form a bond therebetween. The particular shape and configuration of the bonding interface defined by the integration sites 38*a-b* and 39*a-b* can be modified in other embodiments according to need.

In one embodiment, the aperture cup 34 includes a continuous, annular first surface 56 oriented in an outward direction from a continuous second surface 58 that is oriented toward the center of the removable aperture 30. The first surface 56 defines an outer perimeter of the aperture cup 34, and in the present embodiment includes the bonding portion 60 and a plurality of cooling fins 90. Further, the first surface 56 provides a surface for physically engaging the cathode can 22 in a close fit arrangement such that a portion of the first surface abuts a portion of the corresponding surface of the cathode can. In other embodiments, aperture cup 34 and/or cathode can 22 can be configured so as to provide spacing between the first surface 56 of the aperture cup and the cathode can. In either case, the aperture cup 34 is configured for placement at least partially within the cathode can 22 and affixation thereto via the removable bond 40. In one embodiment, the aperture cup 34 is composed of stainless steel, though other suitable materials can also be used.

As mentioned, the first surface 56 of the aperture cup 34 includes the annular bonding portion 60 that is located proximately adjacent a corresponding annular bonding portion 61 defined on the cathode can 22. The bonding portions 60 and 61 provide a suitable interface for the placement of the removable bond 40. So configured, the aperture cup 34 is removably bonded to the cathode can 22, thereby enabling removal of the bond 40 and separation of the aperture cup from the cathode can without damaging either component. The aperture cup 34, the cathode can 22, or both can then be reused, if desired, after minor reconditioning, if needed. Advantageously, this results in overall savings for manufacturing and repair costs. As shown, the bonding portion 60 defines a lip with respect to the portion of the cathode can 22 that defines the bonding portion 61 such that the bonding portion 60 "rests" upon the bonding portion 61. Alternatively, in other embodiments, bonding portion interface configurations that differ in design from the above can also be employed. Also, in the present embodiment the removable bond 40 creates a hermetic seal, though in other embodiments no hermetic seal is defined, depending on the functional requirements of the x-ray tube.

In exemplary embodiments, the cooling fins 90 disposed on the first surface 56 can be situated to be in communication with anyone of various heat removal mediums, including a coolant-based cooling system, circulated air, etc. When in communication with the coolant-based cooing system, for instance, the cooling fins 90 can interact with the coolant in a manner similar to that described with respect to the annular cooling fins 68 disposed on the exterior surface 50 of the aperture shield 32. Alternatively, when contacting air, the cooling fins 90 can facilitate cooling of the aperture cup 34 by transferring heat thereto.

In the illustrated embodiment, the second surface 58 of the aperture cup 34 further defines the annular upper integration sites 39*a* and annular lower integration sites 39*b*, as previously discussed. The integration sites 39*a-b* on the aperture cup 34 are positioned and configured for mating with the integration sites 38*a-b* on the aperture shield 32. The integration sites 38*a-b* and 39*a-b* are cooperatively notched so as to provide a secure fit between the aperture shield 32 and the aperture cup 34. Alternatively, these integration sites 38*a-b* and 39*a-b* can be defined to include other features to facilitate joining the aperture shield 32 with the aperture cup 34. In any event, the integration of the aperture cup 34 with the aperture shield 32 operates to form the removable aperture 30.

As discussed, the second surface 58 of the aperture cup 34 partially defines the fluid reservoir 36. In detail, a portion of the second surface 58 is oriented inwardly to cooperate with the exterior surface 50 of the aperture shield 32 to define the fluid reservoir 36. As such, the aperture cup 34 is in thermal communication with the coolant contained by the fluid reservoir 36. In the illustrated embodiment, the aperture cup 34 also includes fittings 70 and fluid ports 72 to facilitate the circulation of coolant into and out of the fluid reservoir 36. In order to enhance cooling and the transfer of heat into the coolant, it is preferred that the aperture cup 34 be comprised of a thermally conducting metal, such as stainless steel. This enables heat generated in other portions of the x-ray tube to be conducted through the aperture cup 34 to the coolant.

In order to enable coolant circulation via the fluid reservoir 36 and the fluid passageways 62 of the removable aperture, the aperture cup 34 includes fittings 70 and inlet and outlet fluid ports 72, one set of which is shown in FIG. 2. Generally, the fluid ports 72 enable the introduction of cooling fluid into, and/or the removal of fluid from, the fluid reservoir 36. The exemplary fluid ports 72 are generally cylindrical in shape and can take the form of a male or female thread connection. However, the fluid port 72 may, more generally, be configured and/or arranged to mate with any of a variety of other types of fittings and components. Examples of such other fittings and components include, but are not limited to, welded or brazed fittings, quick disconnect fittings, compression fittings, and flange fittings.

The removable aperture 30 participates in heat removal from portions of the x-ray tube via a cooling system as explained, in accordance with one embodiment. During tube operation, backscatter and stray electrons are prevented from adversely striking the anode 42 (FIG. 1) by being captured by the electron collection surface 28 of the removable aperture 30. Upon capture, much of the kinetic energy of the electrons is converted to heat that is absorbed by the electron collection surface 28. This heat is conducted throughout the entire aperture shield 32 and even into the aperture cup 34. Coolant, such as a liquid coolant, is continually circulated through the fluid reservoir 36 via the fluid ports 72. Heat absorbed by the aperture shield 32 and aperture cup 34 is then transferred to the circulating coolant. Indeed, significant quantities of heat are transferred from the cooling fins 68 of the aperture shield 32 by coolant circulated via the fluid passageways 62. Thus, the circulating coolant draws the heat from the various surfaces defining the fluid reservoir 36 before being replaced by fresh coolant flowing through the fittings 70 and fluid ports 72. The heated coolant is then cooled by a heat exchanger (not shown) before reintroduction into the fluid reservoir 36 or other portion of the cooling system. Note that the components described herein are simply part of a complete cooling system utilized by the x-ray tube in cooling various portions thereof, and as such, various modifications can be made while still residing within the scope of the present invention.

Since the electron collection surface 28 can be a major source of heat, in preferred embodiments the aperture shield 32 has the potential of being heated to a substantially higher temperature in comparison to the aperture cup 34. When this occurs, the aperture cup 34 and coolant in the fluid reservoir 36 act as heat sinks to draw heat from the aperture shield 32. As such, the orientation of the fluid reservoir 36 being between the aperture cup 34 and the aperture shield 32 provides for heat to be transferred, dissipated, and distributed throughout the entire removable aperture 30, thereby, enabling a steady-state heat distribution to be achieved. This in turn reduces the effects of temperature-induced strains or stresses at the integration sites 38*a-b* and 39*a-b*, or other portions of the removable aperture 30, thereby increasing the longevity and durability of the removable aperture and x-ray tube.

Figure 3:
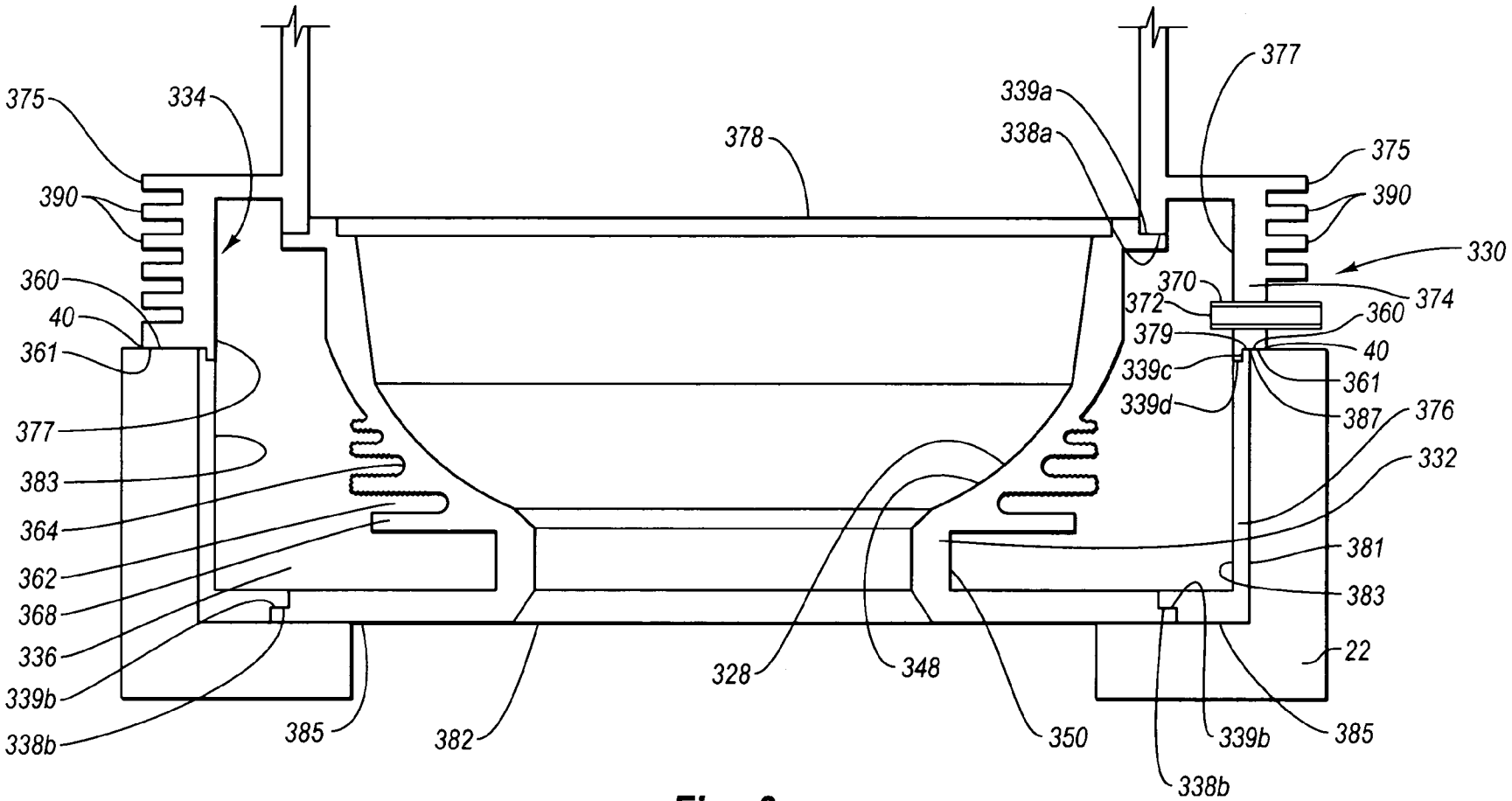
FIG. 3 is cross-sectional view of one embodiment of a removable aperture structure.

FIG. 3 depicts another embodiment of a removable aperture, generally designated at 330, in accordance with the present invention. The removable aperture 330 includes an aperture shield 332 and aperture cup 334, wherein the aperture cup includes an upper aperture cup 374 and a lower aperture cup 376. Additionally, the aperture shield 332 and the aperture cup 334 cooperate to form a fluid reservoir 336.

In the illustrated embodiment, the aperture shield 332 is similar to the aperture shield 32 depicted in FIG. 2. Briefly, the aperture shield 332 includes an interior surface 348 and an exterior surface 350. The interior surface 348 is integrated with an electron collection surface 328, and the exterior surface 350 has fluid passageways 362, recesses 364, and cooling fins 368, all of which cooperate to form a portion of a fluid reservoir 336. Moreover, the aperture shield 332 includes upper integration sites 338*a* and lower integration sites 338*b*.

When joined together, the combination of the upper aperture cup 374 and the lower aperture cup 376 forms a component that is substantially similar with the aperture cup 34 illustrated and described with regard to FIG. 2. However, by being configured as separate pieces that can be joined, the separate upper aperture cup 374 and lower aperture cup 376 provide features that allow for improved fabrication of the removable aperture 330 as well as its integration with the cathode can 22. Both the upper aperture cup 374 and lower aperture cup 376 can be comprised of stainless steel or other suitable material.

In accordance with the above discussion, the upper aperture cup 374 has a first side 375 that is opposite a second side 377, with a bottom side 379 therebetween. More particularly, the first side 375 is oriented outwardly and away from the center of the removable aperture 330, while the second side 377 is oriented inwardly and toward the center of the removable aperture 330. The first side 375 can include optional cooling fins 390, which function to cool the upper aperture cup 374, as described above in connection with the discussion regarding FIG. 2. Also, the first side 375 includes a removable bonding portion 360 configured to receive a removable bond 340 as described above. The second side 377 includes an upper integration site 339*a*, and the bottom side 379 includes a lower integration site 339*c*. Additionally, the upper aperture cup 374 can include fittings 370 and fluid ports 372, as described herein, in order to provide coolant to and from the fluid reservoir 336.

The lower aperture cup 376 has a first side 381 that is opposite a second side 383, with a bottom side 385 and top side 387 therebetween. Similar to the upper aperture cup 374, the first side 381 of the lower aperture cup 376 is oriented outwardly and away from the center of the removable aperture 330, and the second side 383 is oriented inwardly toward the center of the removable aperture. As illustrated, the first side 381 is configured to engage a portion of the cathode can 22, and the second side 383 is configured to define a portion of the fluid reservoir 336. Also, the bottom side 385 includes a lower integration site 339*b*, and is configured to contact a portion of the cathode can 22 or other structure therebetween. Additionally, the top side 387 of the lower aperture cup 376 includes an upper integration site 339*d*, wherein the top side 387 and the upper integration site 339*d* include the same portion of the lower aperture cup 376.

In this illustrated embodiment, the upper aperture cup 374 includes the removable bonding portion 360 that receives a removable bond 40 with the cathode can 22. Accordingly, the upper aperture cup 374 can be removably bonded with the cathode can 22, as described in the other embodiments described herein.

Additionally, the upper aperture cup 374 is integrated with an upper portion 378 of the aperture shield 332. More particularly, the upper integration sites 339*a* on the upper aperture cup 374 are configured to mate with the upper integration sites 338*a* on the aperture shield 332. Accordingly, these components are permanently joined together by brazing or other suitable means, as described above. Additionally, the lower aperture cup 376 is integrated with a lower portion 382 of the aperture shield 332. Similarly, the lower integration sites 339*b* on the lower aperture cup 376 are configured to mate with the lower integration sites 338*b* on the lower portion 382 of the aperture shield 332. Moreover, the lower integration sites 339*c* on the upper aperture cup 374 can be optionally configured to mate with the upper integration sites 339*d* on the lower aperture cup 376, thereby defining the complete aperture cup 334. Thus, the aperture shield 332 can be integrated with both the upper aperture cup 374 and the lower aperture cup 376 in order to form the removable aperture 330.

In one embodiment, the upper aperture cup 374 and lower aperture cup 376 are configured to be integrated to the aperture shield 332 in a manner that provides support and orientation to the aperture shield 332 with respect to the cathode can 22. In the illustrated removable aperture 330, both the upper aperture cup 374 and the lower aperture cup 376 cooperate with the aperture shield 332 to form the fluid reservoir 336. The fluid reservoir 336 is substantially the same as described in connection with other embodiments of the present invention.

Figure 4:
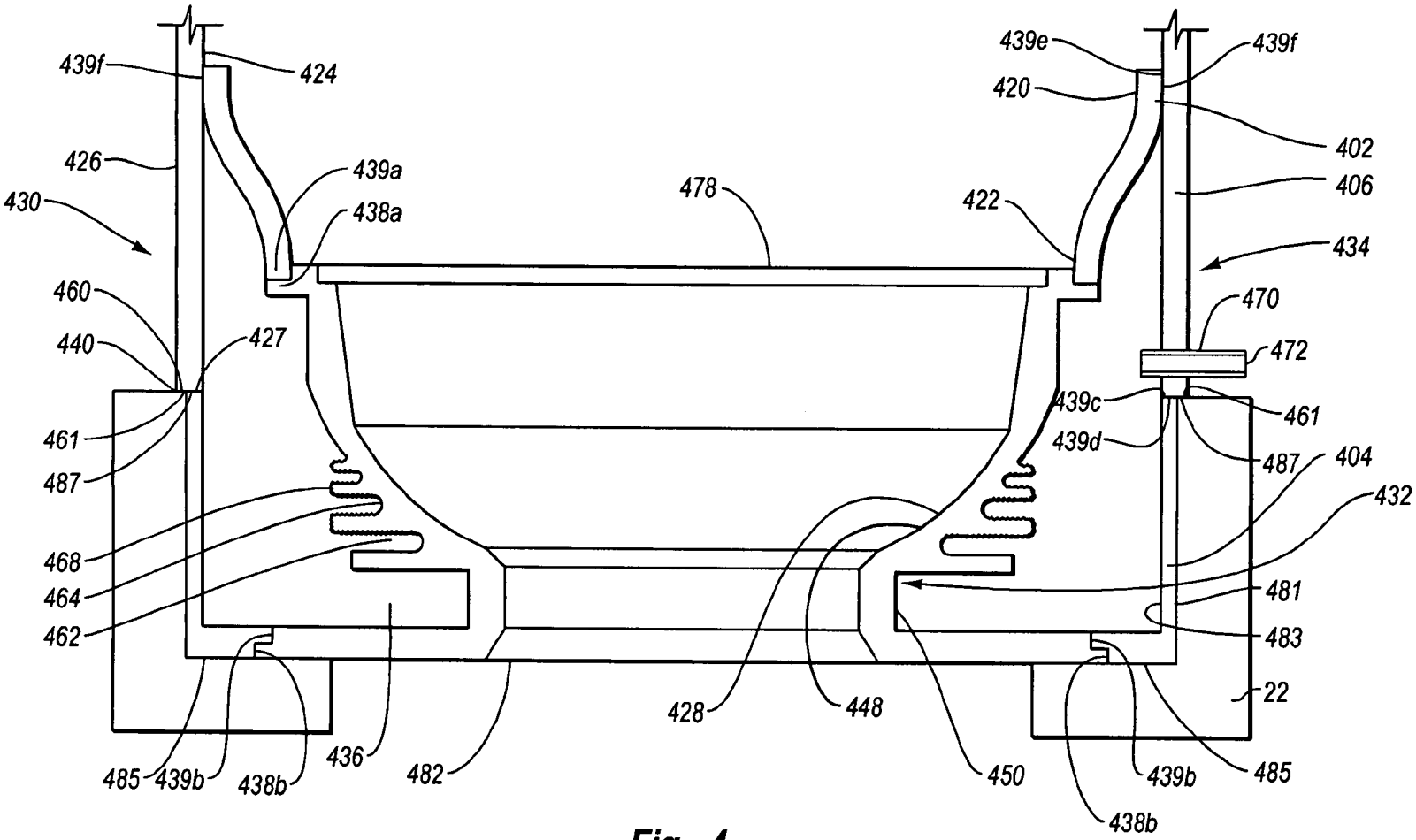
FIG. 4 is cross-sectional view of one embodiment of a removable aperture structure.

FIG. 4 illustrates yet another exemplary removable aperture, generally designated at 430 in accordance with one embodiment of the present invention. The removable aperture 430 includes an aperture shield 432, and an aperture cup 434 comprised of an upper aperture cup 402, a lower aperture cup 404, and an aperture fluid sleeve 406. As before, the aperture shield 432 is similar to the aperture shield 32 illustrated and described with respect to FIG. 2, and the aperture shield 432 and aperture cup 434 cooperate to form a fluid reservoir 436. Briefly, the aperture shield 432 includes an interior surface 448 and an exterior surface 450. The interior surface 448 is integrated with an electron collection surface 428, and the exterior surface 450 has fluid passageways 462, recesses 464, and cooling fins 468, all of which cooperate to form a portion of the fluid reservoir 436. Moreover, the aperture shield 432 includes upper integration sites 438*a* and lower integration sites 438*b*.

Additionally, the lower aperture cup 404 is substantially the same as the lower aperture cup 376 illustrated and described with respect to FIG. 3. Briefly, the lower aperture cup 404 has first side 481 that is opposite a second side 483, with a bottom side 485 and top side 487 therebetween. As illustrated, the first side 481 is configured for engagement with the cathode can 22, and the second side 483 is configured to define another portion of the fluid reservoir 436. Also, the bottom side 485 includes a lower integration site 439*b*, and is configured to contact a portion of the cathode can 22 or other structure therebetween. Additionally, the top side 487 includes an upper integration site 439*d*. The lower aperture cup 404 can include a removable bonding portion 460, as has been described herein. In one embodiment, the lower aperture cup 404 is composed of a thermally conductive material, such as stainless steel.

The upper aperture cup 402 has a generally annular shape and includes an upper portion 420 having a specified diameter and reduced-diameter lower portion 422. More particularly, the upper portion 420 includes an upper integration site 439*e*, and the lower portion 422 has a lower integration site 439*a*. Similar to the lower aperture cup 404, the upper aperture cup 402 is preferably composed of a thermally conductive material, such as stainless steel or the like.

The aperture fluid sleeve 406 includes a first side 424, second side 426, and a bottom side 427. The first side 424 is oriented inward toward the center of the removable aperture 430, while the second side 426 is oriented outward from the center thereof. The first side 424 of the aperture fluid sleeve 406 includes an upper integration site 439*f*, and the bottom side 427 optionally includes a lower integration site 439*c*. Also, the first side 424 includes fittings 470 and fluid ports 472, as described herein for providing a flow of coolant to the fluid reservoir 436. Further, the second side 426 of the aperture fluid sleeve 406 has a removable bonding portion 460 that receives a removable bond 440 with the cathode can 22, where such removable bonds have been described in detail above. Accordingly, the aperture fluid sleeve 406 can be removably bonded with the cathode can 22. The aperture fluid sleeve 406 can be composed of a thermally conductive material, such as stainless steel or the like.

In the present embodiment, the upper aperture cup 402 is mated with an upper portion 478 of the aperture shield 432. More particularly, the lower integration sites 439*a* on the upper aperture cup 402 are configured to mate with upper integration sites 438*a* on the aperture shield 432. Also, the upper integration sites 439*e* on the upper aperture cup 402 are configured to mate with the upper integration sites 439*f* on the aperture fluid sleeve 406.

Furthermore, the lower aperture cup 404 is integrated with a lower portion 482 of the aperture shield 432. As described above, the lower integration sites 439*b* on the lower aperture cup 404 are configured to mate with the lower integration sites 438*b* on the lower portion 482 of the aperture shield 432. Optionally, the upper integration sites 439*d* on the lower aperture cup 404 can be configured to mate with the lower integration sites 439*c* on the aperture fluid sleeve 406. Thus, the aperture shield 432 can be integrated with the upper aperture cup 402 and the lower aperture cup 404, and the aperture fluid sleeve 406 can be integrated with the upper aperture cup 402, and, optionally, integrated with the lower aperture cup 404. In any event, each of these integration sites can be permanently joined together by brazing or other suitable bonding means, as described above. Thus, the aperture shield 432, upper aperture cup 402, lower aperture cup 404, and aperture fluid sleeve 406 are integrated together to form an embodiment of the removable aperture 430.

In one embodiment, the aperture fluid sleeve 406 and the lower aperture cup 404 define a removable bonding portion 460 for removably bonding these components to the cathode can 22, where such removable bonding has been described in detail above. Thus, the upper aperture cup 402, the aperture fluid sleeve 406, and the cathode can 22 are interconnected via a removable bond 440, as described above. Alternatively, only one of the aperture fluid sleeve 406 and the lower aperture cup 404 forms a removable bond 440 with the cathode can 22. This can facilitate ease of both the fabrication of the removable aperture 430, as well as its integration with the cathode can 22.

Additionally, the upper aperture cup 402, lower aperture cup 404, and the aperture sleeve 406 cooperate with the aperture shield 432 in the present embodiment to define the fluid reservoir 436. Also, the fluid reservoir 436 is configured to be coupled with a coolant system via the fluid ports 472 or other suitable means, as described herein, to facilitate cooling of the removable aperture 430.

Figure 5A:
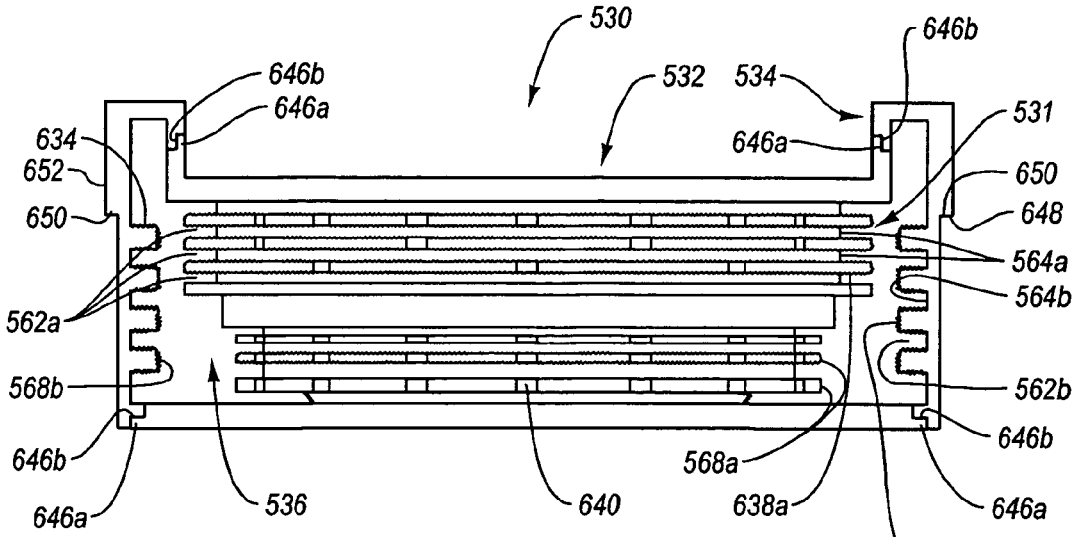
FIG. 5A is a side view of an aperture shield and a cross sectional view of an aperture cup, according to one embodiment.

With reference now to FIG. 5A, additional details are provided regarding various features of a removable aperture, generally designated here at 530. The aperture shield 532 has an exterior surface 531 that at least partially defines the fluid passageways 562*a* and/or a fluid reservoir 536, and is thus configured to be in fluid communication with a coolant. As such, the exterior surface 531 is designed for facilitating heat transfer, and may also be referred to as a heat transfer surface 638*a*, for the purposes of describing additional features and functionalities of the present invention. For example, the fluid passageways 562*a*, recesses 564*a*, and cooling fins 568*a* that are disposed on the aperture shield 532 are part of the heat transfer surfaces 638*a*.

In particular, the fluid passageways 562*a* are annular structures defined about an outer periphery of the aperture shield 532. The fluid passageways 562*a* are formed with a plurality of spaced apart recesses 564*a* and cooling fins 568*a*, similar to those described in previous embodiments. The plurality of passageways 562*a* may be in fluid communication with one another due to gaps 640 formed into the cooling fins 568*a* between adjacent fluid passageways 562*a*, or via the fluid reservoir 536.

Figure 5B:
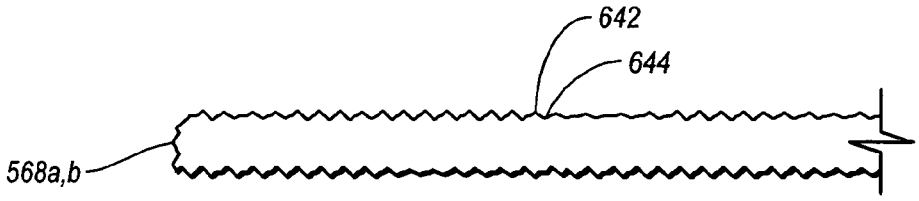
FIG. 5B is a cross sectional view of a cooling fin shown in FIG. 5A.

As depicted in FIGS. 5A and 5B, each heat transfer surface 638*a* may include a roughened surface area that operates to increase the amount of heat transfer, which rough surfaces are defined by a plurality of microridges 642 and microgrooves 644. Accordingly, the microridges 642 and microgrooves 644 are adjacently disposed to each other on the heat transfer surface 638*a* of the fluid reservoir 536, fluid passageways 562*a*, recesses 564*a*, and cooling fins 568*a*. Formation of the microridges 642 and microgrooves 644 may be accomplished by any of a number of processes, including, but not limited to, cutting, forming, attaching, defining, or otherwise machining these formations. In one embodiment, the microridges 642 and microgrooves 644 generally define "V" or "U" shaped cross sections, as seen in FIG. 5B. Alternatively, one or more of the heat transfer surfaces 638*a* may include a plurality of depressions as well. As used herein, the term "depression" includes, but is not limited to, basins, concavities, dips, hollows, cavities, pockets, voids, craters, pits, grooves, channels, or the like, formed or otherwise defined in these surfaces. Additionally, other structures may be formed into the heat transfer surfaces 638*a* so as to increase the surface area thereof, which increases the surface area available for increasing heat transfer from the aperture shield 532.

FIGS. 5A and 5B further depict additional and optional features of the aperture cup 534. It should be noted that these additional and optional features of the aperture cup 534, depicted and described in relation to FIG. 5A, may be employed in embodiments described in connection with FIGS. 2-4. Similar to the aperture shield 532, the aperture cup 534 can also include a plurality of heat transfer surfaces 638*b* defined on fluid passageways 562*b* and corresponding cooling fins 568*b*. In particular, the heat transfer surfaces 638*b* are formed around an inner surface 634 of the aperture cup 534, and can include fluid passageways 562*b*, recesses 564*b*, and cooling fins 568*b*, which are similar in design to the fluid passageways 562*a*, recesses 564*a*, and cooling fins 568*a* of the aperture shield 532. As such, the fluid passageways 562*b*, recesses 564*b*, and cooling fins 568*b* further include microridges 642 and microgrooves 644 to enhance heat transfer to coolant circulating within the fluid reservoir 536.

With continuing reference to FIG. 5A, the aperture shield 532 and aperture cup 534 include joint surfaces 646*a*-*b* that are configured for the mating of these components. Accordingly, after the aperture shield 532 is inserted into the aperture cup 534, the joint surfaces 646*a* on the aperture shield 532 are oriented outwardly towards the aperture cup 534. Correspondingly, the joint surfaces 646*b* on the aperture cup 534 are oriented inwardly toward the aperture shield 532. In order to facilitate placement and integration, the joint surfaces 646*a*-*b* can define corresponding notches, rough surfaces, slots and grooves, or other surfaces to mate the aperture shield 532 with the aperture cup 534. Brazing, welding, or other suitable bonding technique can be used for such mating.

Additionally, the aperture cup 534 includes a removable bonding surface 648 that is configured to be bonded with the cathode can (not shown). Various configurations of removable bonding surfaces 648 can be used. One such configuration is shown in FIG. 5A and includes a lip 650 defined on an outer peripheral surface 652 of the aperture cup 534. The lip 650 is configured such that when the removable aperture 530 is inserted into the cathode can, the lip positions the removable aperture 530 with respect to the x-ray tube. When the removable aperture 530 is properly positioned, the removable bond (not shown) can be formed at the removable bonding surface 648 defined in part by the lip 650. Alternatively, the removable bonding surface 648 can be any surface interface that is disposed between the aperture cup 534 and the cathode can, and does not have to be configured into any particular conformation. As such, any interfacial location between the cathode can and aperture cup 534 that is accessible so as to be capable of forming and removing a removable bond may be used for creating the removable bond, as described above.

In addition to the structural configuration of a removable aperture and/or x-ray tube including the same, embodiments of the present invention serve to provide economical alternatives for manufacturing and using the removable aperture and/or associated x-ray tube. As such, the present invention provides methods of manufacturing the removable aperture, where in such methods include preparing and integrating the various components of the removable aperture together before being bonded with the cathode can. Thus, the methods that include manufacturing and/or disassembling an x-ray tube and/or a removable aperture are in accordance with the present invention.

In one embodiment, a method of manufacturing a removable aperture includes an act of fabricating an aperture shield. During such an act, the process can include machining fluid passageways, recesses, and cooling fins into the outer peripheral surface of the aperture shield. Additionally, the act of fabricating can include an act of shaping the aperture and/or electron collecting surface to facilitate capturing stray or backscatter electrons within an x-ray tube during operation. This can include an act of shaping the electron collection surface into a frustoconical shape. Also, the act of fabricating can include an act of affixing the electron collection surface to the aperture shield. Further, the act of fabricating includes an act of configuring the aperture shield to be capable of being integrated with an aperture cup. This includes an act of forming integration sites that are capable of being brazed or otherwise permanently joined with the aperture cup.

In another embodiment, a method of manufacturing a removable aperture includes an act of fabricating an aperture cup. In alternative embodiments, the act of fabricating can include the separate acts of forming the individual pieces of a one-piece aperture cup, a two-piece aperture cup (e.g., upper aperture cup and lower aperture cup), a three-piece aperture cup (e.g.; upper aperture cup, lower aperture cup, and aperture fluid sleeve), or other multi-component aperture cup. Additionally, the act of fabricating may include an act of forming fluid passageways, recesses, and cooling fins into the inner and/or outer surface of the aperture cup. Further, the act of fabricating includes an act of configuring the aperture cup to be capable of being integrated with the aperture shield, which includes the act of forming integration sites capable of being brazed or forming some other permanent joint. Furthermore, the act of fabricating includes an act of forming a removable bonding portion on the external periphery of the aperture cup, which is configured for receiving a removable bond with the cathode can. Also, this includes an act of orienting the removable bonding portion so that the removable bond is accessible to facilitate the removal of the removable bond.

Optionally, a method includes separate acts of adjoining the subcomponents of the aperture cup together into a single piece. In some cases, these subcomponents may be adjoined before or after being integrated with the aperture shield. In one case, the upper aperture cup and lower aperture cup are integrated with the aperture shield. In another case, the aperture fluid sleeve is adjoined, by integration or a removable bond, to the upper aperture cup and/or the lower aperture cup. Alternatively, the entire aperture cup can be assembled before being integrated with the aperture shield.

Also, the separate acts of adjoining can be performed indirectly, which includes the upper aperture cup being adjoined with the aperture fluid sleeve, and the aperture shield indirectly adjoining the upper aperture cup with the lower aperture cup by being integrated to both components. As such, the aperture fluid sleeve is adjoined with the lower aperture cup without being directly permanently integrated therewith. Another example of indirectly adjoining can be exemplified in a two-piece aperture cup by integrating both the upper aperture cup and the lower aperture cup to the aperture shield without forming a bond or joint between the upper aperture cup and the lower aperture cup.

In another embodiment, a method includes an act of integrating the aperture shield with the aperture cup to form the removable aperture. The integrating may be performed by various separate acts that depend on the number of subcomponents comprising the aperture cup (e.g., one, two, or three-piece aperture cup). In all cases, the method includes an act of integrating an upper portion of the aperture shield with an upper portion of the aperture cup (e.g., upper aperture cup or aperture fluid sleeve). Also, the method includes an act of integrating a lower portion of the aperture shield with a lower portion of the aperture cup (e.g., lower aperture cup). Additionally, the integrating can include an act of brazing the aperture shield to the aperture cup.

Another embodiment of the present invention includes a method for removably bonding the removable aperture with the cathode can. This includes an act of inserting the removable aperture into the cathode can, and an act of positioning the removable aperture with respect to the cathode can so that the aperture is capable of having electrons pass therethrough. Additionally, the method includes an act of forming a removable bond between the removable aperture and the cathode can. Accordingly, this includes an act of forming a removable weld, or other removable bond, that hermetically seals the removable aperture to the cathode can in a manner that allows for the weld to be cut without damaging the cathode can and/or the removable aperture.

In another embodiment, a method is provided for removing the removable aperture from the cathode can, which includes removing the removable bond. Accordingly, this includes an act of cutting the removable bond or otherwise disengaging the removable bond from at least one of the removable aperture and the cathode can. Additionally, after the removable bond has been removed, an act of separating the removable aperture from the cathode can is performed. Cumulatively, the method results in a cathode can and/or removable aperture that is reusable. However, the cathode can and/or removable aperture might need minor cleaning and/or reconditioning before being capable of reuse. In any case, the cathode can and/or removable aperture is not destroyed so as to be scrapped after the removable aperture is removed therefrom.

Since these two components are separable without substantially damage occurring to either, the cathode can and the removable aperture are reusable, as discussed above. Any reconditioning prior to component reuse can include removing portions of the removable bond that may still be attached to the cathode can and/or removable aperture, and the preparation the removable bonding surface so that a new removable bond may be placed thereon.

The present invention provides for simplified cathode can design. In particular, the cathode can need not be designed to include fluid passageways, heat transfer surfaces, or other features that are found in the removable aperture. Thus, cathode can fabrication is substantially simplified, resulting in costs savings.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An x-ray tube, comprising:

an evacuated envelope within which a cathode and an anode are disposed, the anode being positioned to receive electrons emitted by the cathode, and the evacuated envelope being at least partially defined by a cathode can;

a removable aperture structure partially received in the cathode can, the removable aperture structure comprising first and second components, at least one of the components defining an aperture configured to allow electrons to pass from the cathode to the anode;

a first bond located at a first integration site of the first and second components of the removable aperture structure and the first bond being attached to the first and second components, where the first bond is a permanent bond; and a second bond attached to the cathode can and the removable aperture structure, where the second bond is a removable bond.

2. An x-ray tube as in claim 1, wherein the removable aperture structure further comprises a fluid reservoir formed therein.

3. An x-ray tube as in claim 2, wherein the removable aperture structure includes at least one fluid passageway in fluid communication with the fluid reservoir.

4. An x-ray tube as in claim 1, wherein the first and second components respectively comprise an aperture shield portion and an aperture cup portion, the second bond being formed between the cathode can and the aperture cup portion.

5. An x-ray tube as in claim 4, wherein the aperture cup includes an upper aperture cup and a lower aperture cup.

6. An x-ray tube as in claim 4, wherein the aperture cup includes an upper aperture cup, a lower aperture cup, and an aperture fluid sleeve, the aperture fluid sleeve being coupled with the upper aperture cup.

7. The x-ray tube as recited in claim 1, wherein the first bond has a first set of associated characteristics, and the second bond has a second set of associated characteristics, the respective characteristics of the first and second bonds being such that the cathode can and the removable aperture structure can be separated from each other relatively easier than the first and second components can be separated from each other.

8. The x-ray tube as recited in claim 1, wherein the removable aperture structure includes a plurality of heat transfer surfaces.

9. An x-ray tube, comprising:

an evacuated envelope within which a cathode and an anode are disposed, the anode being positioned to receive electrons emitted by the cathode, and the evacuated envelope being at least partially defined by a cathode can;

an aperture structure positioned between the cathode and the anode and at least partially received within the cathode can; and an annular removable bond attached to the aperture structure and the cathode can, wherein the annular bond is the only bond formed between the aperture structure and the cathode can.

10. An x-ray tube as in claim 6, further comprising:

a third bond formed at a second integration site of the first and second components, the third bond being a permanent bond wherein the first bond formed at the first integration site integrates the upper aperture cup with an upper portion of the aperture shield and the third bond formed at the second integration site integrates the lower aperture cup with a lower portion of the aperture shield.

11. A An x-ray tube as in claim 10, wherein each of the first and third bonds formed at the first and second integration sites, respectively, is a braze joint.

12. The x-ray tube as recited in claim 9, wherein the removable aperture structure includes a plurality of heat transfer surfaces.

13. An x-ray tube, comprising:

an evacuated envelope within which a cathode and an anode are disposed, the anode being positioned to receive electrons emitted by the cathode, and the evacuated envelope being defined in part by a cathode can;

an aperture fluid sleeve attached to the cathode can;

a removable aperture structure partially received in the cathode can;

an upper aperture cup attached to the removable aperture structure and to the aperture fluid sleeve; and a lower aperture cup attached to the removable aperture structure and to the cathode can, the lower aperture cup cooperating with the aperture fluid sleeve, removable aperture structure and upper aperture cup to define a portion of a fluid passageway.

14. The x-ray tube as recited in claim 13, wherein one or both of the upper aperture cup and the lower aperture cup are each attached to the aperture fluid sleeve by way of a permanent bond.

15. The x-ray tube as recited in claim 13, wherein the upper aperture cup is attached to the removable aperture structure by way of a permanent bond.

16. The x-ray tube as recited in claim 13, wherein the lower aperture cup is attached to the removable aperture structure by way of a permanent bond.

17. The x-ray tube as recited in claim 13, wherein one or both of the aperture fluid sleeve and the lower aperture cup are each attached to the cathode can by way of a removable bond.

18. The x-ray tube as recited in claim 13, wherein the removable aperture structure includes a plurality of heat transfer surfaces.

19. The x-ray tube as recited in claim 13, wherein:

two components of the x-ray tube are attached to each other with a permanent bond; and two components of the x-ray tube are attached to each other with a removable bond.

* * * * *

UNITED STATES PATENT AND TRADEMARK OFFICE

CERTIFICATE OF CORRECTION

PATENT NO. : 7,486,774 B2
APPLICATION NO. : 11/137064
DATED : February 3, 2009
INVENTOR(S) : Bruce A. Cain It is certified that error appears in the above-identified patent and that said Letters Patent is hereby corrected as shown below:

In The Specification:

Column 1
Line 38, change "into-photons" to --into photons--

Column 3
Line 3, change "enclosure The" to --enclosure. The--

Column 4
Line 20, change "skilled" to --skill--

Column 11
Line 35, change "340" to --40--

In The Claims:

Column 18, Claim 10
Line 14, change "bond wherein" to --bond, wherein--

Signed and Sealed this

Twenty-seventh Day of July, 2010

David J. Kappos

David J. Kappos
*Director of the United States Patent and Trademark Office*